United States Patent [19]

Medovar et al.

[11] 4,279,642

[45] Jul. 21, 1981

[54] METHOD FOR ELECTROSLAG REMELTING OF METALS

[76] Inventors: Boris I. Medovar, ulitsa Anri Barbjusa, 22-26, kv. 109; Vitaly M. Baglai, bulvar Lesi Ukrainki, 2, kv. 51; Vasily I. Us, ulitsa Saxaganskogo, 58, kv. 12; Alexei G. Bogachenko, ulitsa Sapernoe pole, 26a, kv. 30; Grigory A. Timashov, bulvar Davydova, 7, kv. 143; Boris B. Fedorovsky, ulitsa Mechnikova, 7a, kv. 26; Oleg P. Bondarenko, ulitsa Kreschatik, 15, kv. 34; Jury P. Shtanko, ulitsa Dobrokhotova, 26, kv. 53; Viktor L. Artamonov, ulitsa Shumskogo, 8a, kv. 90; Leonid V. Pavlov, prospekt Komarova, 28, kv. 6, all of Kiev; Konstantin S. Eltsov, ulitsa Tbilisskaya, 17, kv. 7, Zaporozhie; Nikolai V. Stetsenko, ulitsa Patrioticheskaya, 34, kv. 32, Zaporozhie; Gary P. Kaganovsky, ulitsa Bocharova, 8, kv. 48, Zaporozhie; Albert N. Korotkov, prospekt Lenina, 228, kv. 2, Zaporozhie; Sergei S. Popov, bulvar Komsomolsky, 66, kv. 63, Zhdanov, Donetskoi oblasti, all of U.S.S.R.

[21] Appl. No.: 136,249

[22] Filed: Apr. 1, 1980

[51] Int. Cl.[3] ..... C22B 4/00

[52] U.S. Cl. ..... 75/10 C; 75/10 R; 75/12; 164/52

[58] Field of Search ..... 75/10 R, 10 C, 11, 12; 164/52, 56, 250, 252

[56] References Cited

U.S. PATENT DOCUMENTS

| | | | |
|---|---|---|---|
| 3,738,825 | 6/1973 | Medovar | 75/10 C |
| 3,776,294 | 12/1973 | Paton | 75/10 C |
| 3,854,932 | 12/1974 | Bishop | 75/49 |
| 4,017,672 | 4/1977 | Paton | 75/10 C |
| 4,027,720 | 6/1977 | Plockinger | 75/10 C |

*Primary Examiner*—P. D. Rosenberg
*Attorney, Agent, or Firm*—Fleit & Jacobson

[57] ABSTRACT

In melting down at least one consumable electrode in an electroslag remelting furnace, a gas is blown into the molten slag in such a manner that the gas flows in a jet towards the consumable electrode portion immersed into the slag to create a slag flow around said portion and thereby accelerate the melting-down of the electrode. The method efficiently eliminates an unbalance in the melting-down rates of two or more electrodes by blowing in the gas at different or controlled flow rates towards every electrode.

8 Claims, 2 Drawing Figures

METHOD FOR ELECTROSLAG REMELTING OF METALS

BACKGROUND OF THE INVENTION

1. Field of the Invention

The present invention pertains to the art of electrometallurgy and more particularly to methods for electroslag remelting of metals. The invention may be employed in installations for producing ingots by electroslag remelting either of one consumable electrode, or of a plurality of groups of such electrodes.

It is common knowledge that the consumable electrode melting-down rate, and consequently the ingot build-up rate, is dependent upon the energy released in the slag bath: the higher the current and the voltage, the greater the ingot build-up rate. This means that increasing the ingot build-up rate entails a rise in the electric power consumption.

2. Description of the Prior Art

Various methods have been proposed to reduce the electric power consumption at a predetermined ingot build-up rate in the course of electroslag remelting. One of these involves an action upon the slag bath and metal pool with the use of an electromagnetic means, with the result that, at the same electric power consumption, the consumable electrode melting-down rate is accelerated as against that without such action. Employed as the electromagnetic means in this method are inductance coils installed outside the mould, as disclosed in British Pat. No. 1,335,383.

In other prior art electroslag remelting methods, accelerating the consumable electrode melting-down rate without increasing the electric power consumption is attained by imparting to the electrode, apart from its lowering as it melts down, an additional motion in the slag, which additional motion may be a rotary motion around the electrode axis, a vertical (U.S. Pat. No. 3,565,994) or a horizontal (British Pat. No. 1,202,192) oscillatory motion, or a motion along a closed path in a horizontal or a vertical plane. Another prior art method employs for the same purpose power modulation by varying the voltage and the current at definite time intervals, as disclosed in British Pat. No. 1,188,028.

The use of the methods referred to above calls for relatively complicated apparatus and hence entails a higher cost of the equipment and of the process of electroslag remelting of consumable electrodes as a whole.

U.S. Pat. No. 3,776,294 discloses a method for electroslag remelting of metals, consisting in that a gas or a gas mixture is blown into the slag bath in the course of melting of an electrode or electrodes. According to the method, a gas or a gas mixture is blown into the liquid slag in such a manner that the gas bubbles upwards through the liquid slag, thereby upgrading the metal refining quality. Alternatively, the gas may be blown in a jet directed with respect to the mould wall at an angle other than a right angle causing the slag to rotate around the electrode or electrodes and thereby improving the slag-metal interaction.

The velocity of such a slag motion in the zone adjacent the electrode or electrodes, however, is comparable with that of the convective motion and thus fails to appreciably affect the electrode melting-down rate and to markedly reduce the electric power consumption at the predetermined ingot build-up rate.

In the electroslag remelting by the prior art methods of a plurality of consumable electrodes differing in cross-section, the melting-down rates of the electrodes greatly differ from one another, which is particularly pronounced when such electrodes are connected to opposite poles of a current source. This impairs the metal refining quality. Resorting to various electrical-engineering means, such as an equalizing wire connecting the bottom plate to the centre point of the transformer secondary winding, has shown these to be inadequate for equalizing the melting-down rates of electrodes differing in cross-section.

SUMMARY OF THE INVENTION

It is an object of the present invention to provide a method for electroslag remelting of metals, which enables the metal melting-down rate to be varied over a wider range than has heretofore been possible.

A further object of the invention is to provide a method for electroslag remelting of metals, which allows the electric power consumption at a predetermined melting-down rate to reduced.

Still further object of the invention is to provide a method for electroslag remelting of metals, which makes it possible to attain an uniform melting-down of electrodes when two or more electrodes or a plurality of groups thereof are used.

Yet further object of the invention is to provide a method for electroslag remelting of metals, which makes it possible to either increase or decrease the melting-down rate without respectively increasing the electric power consumption and impairing the ingot surface quality.

The above-mentioned and other objects of the invention are attained by providing a method for electroslag remelting of metals, consisting in melting-down at least one consumable electrode in a liquid electrically conductive slag and blowing a gas into said slag, wherein, according to the invention, the gas is blown into the slag in at least one jet directed towards the consumable electrode portion immersed into the slag to create a slag flow around said consumable electrode portion and thereby accelerate the melting-down thereof.

When a gas, such as argon or nitrogen, is blown into the liquid slag in a jet directed towards the consumable electrode portion immersed into the slag, the energy of the gas jet is spent for agitating the liquid slag and creating flows therein, which flows speed up the rates of heat transfer in the liquid slag. An electrode placed into the region of vigorous liquid slag flows melts down at a more rapid rate. An intense directional action of such slag or gas-slag mixture flows makes it possible either to cut down the electric power consumption at a predetermined ingot-built-up rate or to reduce the melting-down rate without impairing the ingot surface quality, and, when two or more electrodes are used, to attain an uniform melting-down thereof.

It has been experimentally established that to create such a slag flow, the gas jet velocity at the nozzle outlet is preferably set to be at least 0.5 m/s per every millimeter of the distance from the nozzle to the electrode. At a lower gas velocity, the slag flow created by the gas jet fails to reach the consumable electrode and hence to accelerate its melting-down. The upper limit of the gas velocity is not critical; it is selected depending on the required electrode melting-down rate with account for ensuring stability of the remelting process.

In the electroslag remelting of two or more consumable electrodes, a difference or imbalance in their melting-down rates may arise, accompanied by a difference in the depths of immersion of the electrodes into the slag bath, with the result that some of the electrodes may eventually come into contact with the metal pool and hence their melting will terminate.

To eliminate the imbalance in the melting-down of at least two consumable electrodes or of at least two groups thereof, a gas is simultaneously blown into the liquid slag in the direction towards every consumable electrode or electrode group, the flow rate of the gas blown in the direction towards an electrode or electrode group deeper immersed into the slag being higher and proportional to the immersion depth thereof.

It has been experimentally established that the difference in the flow rates of the gas blown in towards electrodes immersed to different depths is preferably set to be at least 1 percent of the predetermined flow rate per every millimeter of the difference in the electrode immersion depths.

It is most efficient to maintain the gas flow rate proportional to an electrode immersion depth automatically with the aid of a flow controller adapted for this purpose.

In order to reduce the consumption of a gas in accomplishing the method of the invention, the gas may be blown into the liquid slag in an intermittent or pulsating jet with a pulse duration ranging from 0.02 to 2 minutes.

The above gas pulse duration limits are based on practical considerations of avoiding the use of complex and costly means to effect an intermittent gas feed, inasmuch as shortening the pulse duration below 0.02 minute complicates the construction of means for feeding a gas into the slag, whereas continuing a pulse over 2 minutes lowers the efficiency of the blowing process.

Such an intermittent or pulsating gas feed may be accomplished according to any schedule; however, such one is preferable when the gas is blown in pulses of equal duration at intervals of the same duration between the pulses.

Like the electric power modulation, the pulsating gas feed makes it possible to reduce the electrode melting-down rate without impairing the ingot surface quality.

With the aim to attain a more uniform heat distribution in the slag bath when at least two consumable electrodes or two groups thereof are melted, it is advantageous to phase the gas pulses so that the maximum flow rate of the gas blown into the slag towards the slag-immersed portion of an electrode or electrode group coincides in time with the minimum (or zero) flow rate of the gas blown into the slag towards the slag-immersed portion of an adjacent electrode or electric group.

To attain the highest efficiency in employing the method of the invention, the gas is preferably blown into the slag towards every consumable electrode in at least one jet per every 100 mm of the width or diameter of the electrode.

BRIEF DESCRIPTION OF THE DRAWINGS

The method of the invention will now be explained in greater detail with reference to specific examples of practicing thereof and illustrated in the accompanying drawings, wherein.

DETAILED DESCRIPTION OF PREFERRED EMBODIMENTS OF THE INVENTION

Inasmuch as the method of the invention may be most advantageously utilized in multiple-electrode electroslag remelting furnaces, an example of carrying out the method in a furnace wherein four electrodes are remelted is outlined below.

Figure 1:
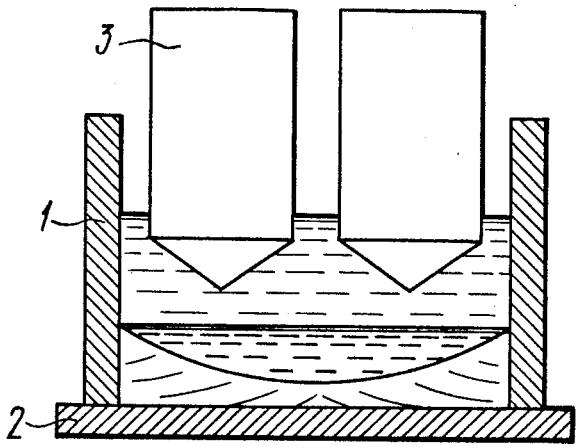
FIG. 1 is a diagrammatic view of an apparatus for electroslag remelting of metals, wherein four consumable electrodes are remelted by the method of the invention.
Figure 2:
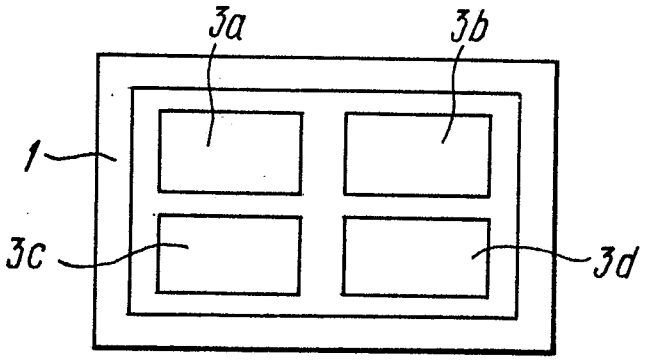
FIG. 2 is a plan view of the apparatus illustrated in FIG. 1.

FIG. 1 diagrammatically illustrates an electroslag remelting furnace comprising a movable rectangular-section mould 1 supported during the initial stage of operation on a bottom plate 2 which subsequently, as the mould is moved upwards, serves as a support for the ingot. The bottom plate 2 may be installed on a carriage (not shown) for conveying or removing the finished ingot beyond the area of production thereof. In the case under consideration, four consumable electrodes 3 are remelted, connected by the "electrode-electrode" circuit; the electrodes are designated by reference numerals 3*a*, 3*b*, 3*c*, and 3*d* (FIG. 2). Being well known in the art, the electrode connection circuit is not shown in the drawings.

In carrying out the method of the invention, a gas is first blown into the slag in the direction towards the portion, immersed into the slag, of a pair of electrodes, e.g. 3*a* and 3*b*, if these melt down at a slower rate than does the pair of electrodes 3*c* and 3*d*. This intensifies the melting-down of the pair of electrodes 3*a* and 3*b*, i.e. a greater amount of metal flows down into the metal pool under this pair of electrodes than under the other pair of electrodes.

If an imbalance in the electrode melting-down rates has arisen, the melting-down rate of the deeper immersed electrodes can be increased by blowing the gas into the slag towards the slag-immersed electrode portions, at different flow rates. As the difference in the electrode immersion depths diminishes, the gas blowing-in rates are equalized. The existence of a difference in the electrode immersion depths is judged from the readings of voltmeters (not shown) connected across every electrode and the ingot being formed.

When remelting two or more electrodes connected by the "electrode-electrode" circuit, the voltages across the melting end of every electrode and the mould body (if the mould is widened in its top portion) or the bottom plate (if the mould has no widened portion) are measured. The difference in the voltages makes it possible to judge of the extent of immersion of electrodes with respect to an electrode whose immersion depth is assumed as normal. In a multiple-electrode electroslag remelting of metals, the majority of electrodes are generally under the same potential with respect to the mould body (bottom plate), so the immersion depth of these electrodes is used as a reference for determining that of other electrodes. An immersion depth corresponding to an 1 V voltage difference at a constant level of energy released in the slag bath is usually determined for a specific ingot.

The method of the invention was tested in an applicant's experimental plant, where four 40×200 mm cross-section consumable electrodes were remelted in a 150×500 mm cross-section, 400 mm high mould. Multiple-passage nozzles wherethrough argon was blown into the slag bath were installed in the mould walls 300 mm from the bottom end of the mould. Every electrode was spaced at 20 mm from the mould wall, and the slag bath level was 80 mm from the top end of the mould. It was experimentally found that a drastic increase in the melting-down rate of these electrodes was attained at an argon velocity at the nozzle outlet of 10 m/s and over. This was accompanied by a 15-percent increase in the electrode melting-down rate at the same level of energy released in the slag bath.

The method of the invention was further tested in commercial electroslag remelting installations using electrodes of different cross-section. The testing showed that thicker electrodes melted down at a slower rate. In the course of a trial melting, the difference in the depths of immersion of the electrodes into the slag reached 20 mm (i.e. 30 mm and 10 mm), and the argon flow rate, when it was blown into the slag bath, amounted to 0.5 1/min for every electrode. To eliminate the difference in the depths of electrode immersion into the slag, the flow rate of argon blown in the direction towards the electrodes immersed to a depth of 30 mm was set at 0.6 1/min, and towards those immersed to a depth of 10 mm, at 0.4 1/min. In three minutes of gas blowing into the slag, the difference in the electrode immersion depths was diminished to 5 mm. When the difference in the argon flow rates was automatically set proportional to the electrode immersion depth, the difference in the electrode immersion depths was eliminated in 0.5 to 1 minute.

With the object to reduce the argon consumption, blowing it in a pulsating jet was tested, the gas feed being shut off with the aid of a solenoid valve. The gas pulse duration was from 0.02 to 2 minutes with intervals of the same duration between pulses, and the frequency was from 0.5 to 50 pulses of equal duration per minute with intervals of the same duration between pulses. This allowed a higher electrode melting-down rate be attained at an argon consumption only half as high as that without a pulsating gas feed. When the intervals between pulses were lengthened, with the same pulse duration, the effectiveness of the method of the invention lowered, whereas shortening the intervals, i.e. increasing the pulsation frequency, called for the use of more complex gas feed means. Reducing the pulsation frequency resulted in impairing the ingot quality.

In the above-described example, the gas was blown into the slag bath, according to the invention, through nozzles whose number opposite every consumable electrode was two, which provided for a jet per evey 100 mm of electrode width. When the gas was blown in through only one nozzle, both the ingot surface quality and the effectiveness of the method were impaired.

While particular embodiments of the invention have been shown and described, it is not intended that the invention be limted to the disclosed embodiments or to the details thereof, since various modifications may be made in the invention without departing from the scope as defined in the appended claims.

What is claimed is:

1. A method for electroslag remelting of metals, which comprises melting down at least one consumable electrode in a liquid electrically conductive slag and blowing a gas into said slag in at least one jet directed toward the consumable electrode portion immersed in the slag with sufficient force to penetrate the slag and to create a flow of said slag around the slag-immersed portion of said consumable electrode and thereby accelerate the melting-down thereof.

2. A method as defined in claim 1, wherein the gas jet velocity at the jet outlet is set to be at least of 0.5 m/s per every millimeter of the distance from the jet to the electrode.

3. A method as defined in claim 1, wherein, when melting down at least two consumable electrodes or two groups thereof, the gas is simultaneously blown into the slag in jets directed towards the slag-immersed portion of every consumable electrode or group of such electrodes, the flow rate of the gas blown in the direction towards the portion of an electrode or a group of such electrodes which is immersed deeper into the slag being higher and proportional to the immersion depth.

4. A method as defined in claim 3, wherein the difference in the flow rates of the gas blown into the slag is set to be at least 1 percent of the average flow rate per every millimeter of the difference in the electrode immersion depths.

5. A method as defined in claim 1, wherein the gas is blown into the slag in an intermittent or pulsating jet with a pulse duration from 0.02 to 2 minutes.

6. A method as defined in claim 5, wherein the gas is blown into the slag in pulses of equal duration and at intervals of the same duration between the pulses.

7. A method as defined in claim 6, wherein, when melting down at least two consumable electrodes or two groups thereof, the gas pulses are phased so that the maximum flow rate of the gas blown into the slag towards the slag-immersed portion of an electrode or electrode group coincides in time with the minimum flow rate of the gas blown into the slag towards the slag-immersed portion of an adjacent electrode or electrode group.

8. A method as defined in claim 1, wherein the gas is blown into the slag towards the slag-immersed portion of a consumable electrode in at least one jet per every 100 mm of the width or diameter of said electrode.

* * * * *